US008344953B1

(12) United States Patent
Gilbrech et al.

(10) Patent No.: US 8,344,953 B1
(45) Date of Patent: Jan. 1, 2013

(54) OMNI-DIRECTIONAL FLEXIBLE ANTENNA SUPPORT PANEL

(75) Inventors: Sid Gilbrech, Sunnyvale, CA (US); Rajendran Venugopalachary, Cupertino, CA (US); Srinivas Sivaprakasam, Fremont, CA (US)

(73) Assignee: Meru Networks, Sunnyvale, CA (US)

( * ) Notice: Subject to any disclaimer, the term of this patent is extended or adjusted under 35 U.S.C. 154(b) by 676 days.

(21) Appl. No.: 12/465,537

(22) Filed: May 13, 2009

Related U.S. Application Data

(60) Provisional application No. 61/052,981, filed on May 13, 2008.

(51) Int. Cl.
*H01Q 1/38* (2006.01)
*H01Q 1/24* (2006.01)

(52) U.S. Cl. ..... 343/702; 343/700 MS

(58) Field of Classification Search ..... 343/700 MS, 343/702, 882
See application file for complete search history.

(56) References Cited

U.S. PATENT DOCUMENTS

| | | | | |
|---|---|---|---|---|
| 5,038,151 | A | 8/1991 | Kaminski | |
| 5,966,094 | A | 10/1999 | Ward et al. | |
| 6,760,318 | B1 | 7/2004 | Bims | |
| 6,788,658 | B1 | 9/2004 | Bims | |
| 6,839,038 | B2 | 1/2005 | Weinstein | |
| 6,894,649 | B2 | 5/2005 | Östervall | |
| 6,933,909 | B2 | 8/2005 | Theobold | |
| 6,954,177 | B2 | 10/2005 | Channabasappa et al. | |
| 6,978,158 | B2 | 12/2005 | Ghavami | |
| 6,999,802 | B2 * | 2/2006 | Kim | 455/575.1 |
| 7,319,685 | B2 | 1/2008 | Kim et al. | |
| 7,333,455 | B1 | 2/2008 | Bolt et al. | |
| 7,359,362 | B2 | 4/2008 | King et al. | |
| 7,433,722 | B2 * | 10/2008 | Sakamoto et al. | 455/575.3 |
| 2005/0152314 | A1 | 7/2005 | Sun et al. | |

OTHER PUBLICATIONS

Habib et al. "Multi-antenna techniques for OFDM based WLAN." Proceedings of First International Conference on Next-Generation Wireless Systems, Jan. 2006, pp. 186-190.

Kitahara et al. "A base station adaptive antenna for downlink transmission in a DS-CDMA system." IEEE 51st Vehicular Technology Conference Proceedings, 2000 (Abstract).

Mahler et al. Design and optimisation of an antenna array for WiMAX base stations. IEEE/ACES International Conference on Wireless Communications and Applied Computational Electromagnetics, 2005 (Abstract).

Miaris et al. "On the base stations antenna system design for mobile communications." Electrical Engineering, 2006, pp. 157-163, vol. 88.

Miura et al. "Study of array pattern tuning method using hybrid genetic algorithms for figure-8 satellite's earth station antenna." Asia-Pacific Microwave Conference Proceedings, 2000 (Abstract).

(Continued)

*Primary Examiner* — Tan Ho

(57) ABSTRACT

An access point housing structure includes a first enclosure, a second enclosure to house an array of antenna patches, and an omni-directional hinge component. The first enclosure includes a first coupling mechanism located near one of the corners of the first enclosure. The second enclosure includes a second coupling mechanism located near a corner corresponding to the location of the first coupling mechanism. The omni-directional hinge component connects to the first coupling mechanism and to the second coupling mechanism and allows rotation of the second enclosure about a first axis along an edge of the first enclosure adjacent to the first coupling mechanism and about a second axis along an edge of the second enclosure adjacent to the second coupling mechanism.

14 Claims, 5 Drawing Sheets

OTHER PUBLICATIONS

Ponnapalli et al. "Design and packaging of antennas for wireless systems." Proceedings of Electrical Performance of Electrical Packaging, 1995 (Abstract).

Sarolic. "Base station antenna near-field radiation pattern distortion analysis." Sixth International Conference on Computational Methods for the Solution of Electrical and Electromagnetic Engineering Problems Incorporating Electromagnetic Effects on Human Beings and Equipment Seminar, 2003 (Abstract).

* cited by examiner

OMNI-DIRECTIONAL FLEXIBLE ANTENNA SUPPORT PANEL

CROSS REFERENCE TO RELATED APPLICATION

This application claims priority from U.S. Provisional Application No. 61/052,981, filed May 13, 2008, in the name of the same inventors.

BACKGROUND

Embodiments of the present invention relate to wireless communication networks. More particularly, embodiments of the present invention relate to a structure to house an access point in a wireless communication network.

SUMMARY OF THE DESCRIPTION

Embodiments of the present invention provide distinct advances in the art of wireless communication networks. Embodiments of the invention provide a housing structure for an access point in a wireless communication network, in which an antenna array can be oriented in space in order to optimize communication between the access point and the wireless communication system. The antenna array housing and system is such that isolation between the various radios preferably is maximized and independent of the orientations of the antennas.

The housing structure comprises a first enclosure, a second enclosure, and an omni-directional hinge component. The first enclosure houses signal processing circuitry. The second enclosure houses an antenna array, which is coupled to the signal processing circuitry. The omni-directional hinge component couples the first and second enclosures. By having this hinge interconnect the two, the antenna unit preferably does not need a separate mounting system and preferably makes deployment easy in all situations.

The first enclosure may be mounted to a stationary object such as a wall, a ceiling, or a tabletop and includes a first coupling mechanism. The second enclosure includes a second coupling mechanism and is generally oriented with respect to the first enclosure. The omni-directional hinge component is connected to the first coupling mechanism and the second coupling mechanism, and allows the second enclosure to rotate approximately 180° about a first axis along an edge of the first enclosure adjacent to the first coupling mechanism. The omni-directional hinge component also allows the second enclosure to rotate approximately 360° about a second axis along an edge of the second enclosure adjacent to the second coupling mechanism. This summary is provided to introduce a selection of concepts in a simplified form that are further described below in the detailed description. This summary is not intended to identify key features or essential features of the claimed subject matter, nor is it intended to be used to limit the scope of the claimed subject matter.

Other aspects and advantages of the present invention will be apparent from the following detailed description of the embodiments and the accompanying drawing figures.

DETAILED DESCRIPTION

Provisional Application

U.S. Provisional Application No. 61/052,981, filed May 13, 2008, in the name of the same inventors, including all parts, text, figures, and technical appendix thereof, is hereby incorporated by reference as if fully set forth herein.

FIGURES AND TEXT

Figure 1:
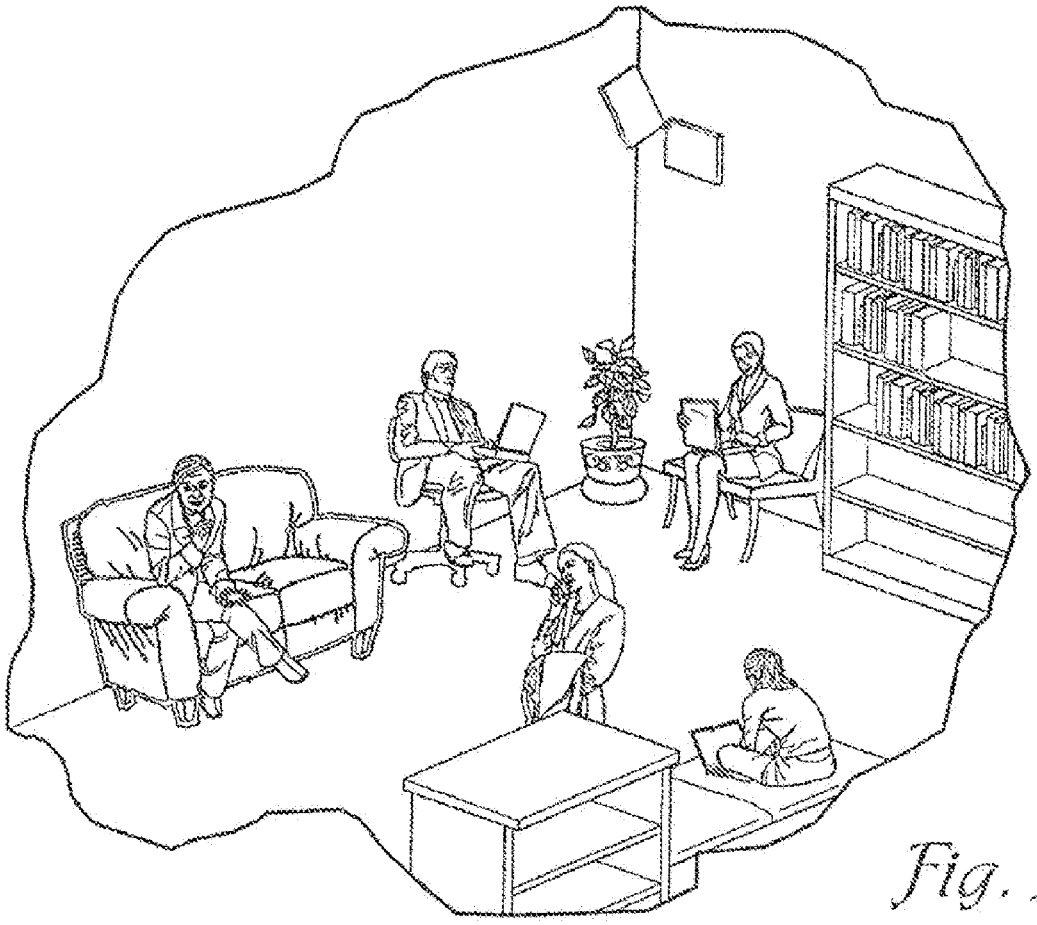
FIG. 1 is a view depicting a wireless communication network that includes a plurality of wireless devices and an access point.
Figure 2:
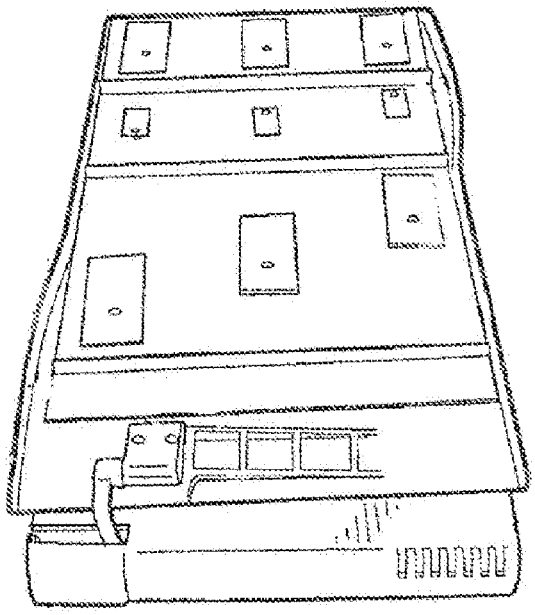
FIG. 2 is a view of the access point housing constructed in accordance with various embodiments of the present invention, the housing including an array of antenna patches.
Figure 3:
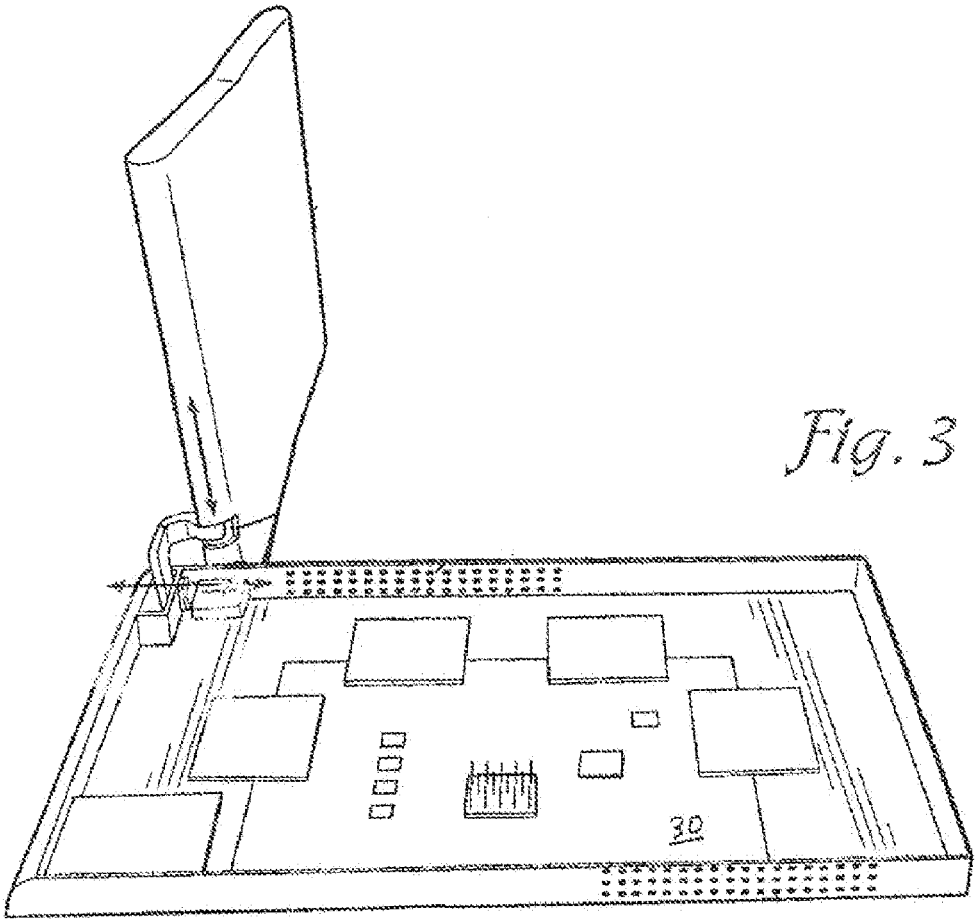
FIG. 3 is a view of the access point housing including a first enclosure and a second enclosure.
Figure 4:
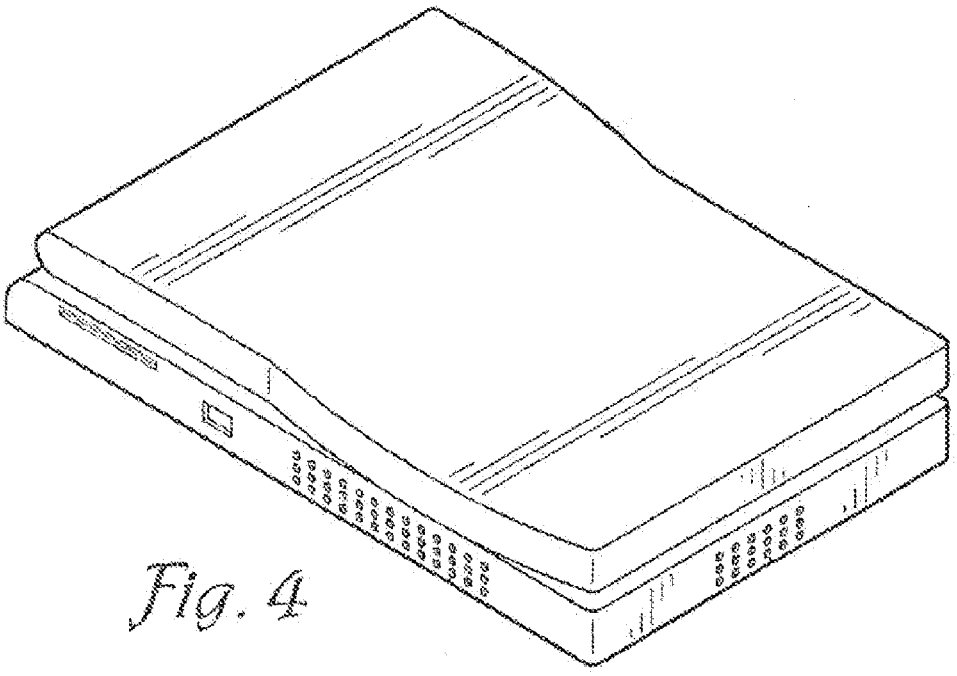
FIG. 4 is a view of the access point housing with the second enclosure separated from the first enclosure.
Figure 5:
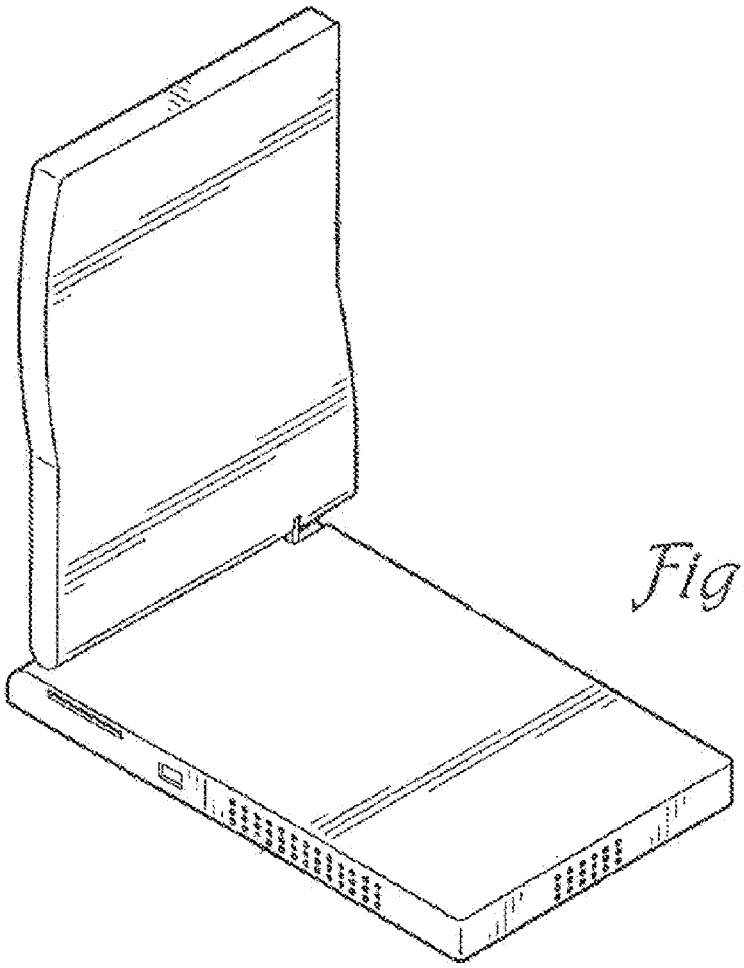
FIG. 5 is a view of the access point housing with the second enclosure at a 90-degree angle from the first enclosure.
Figure 6:
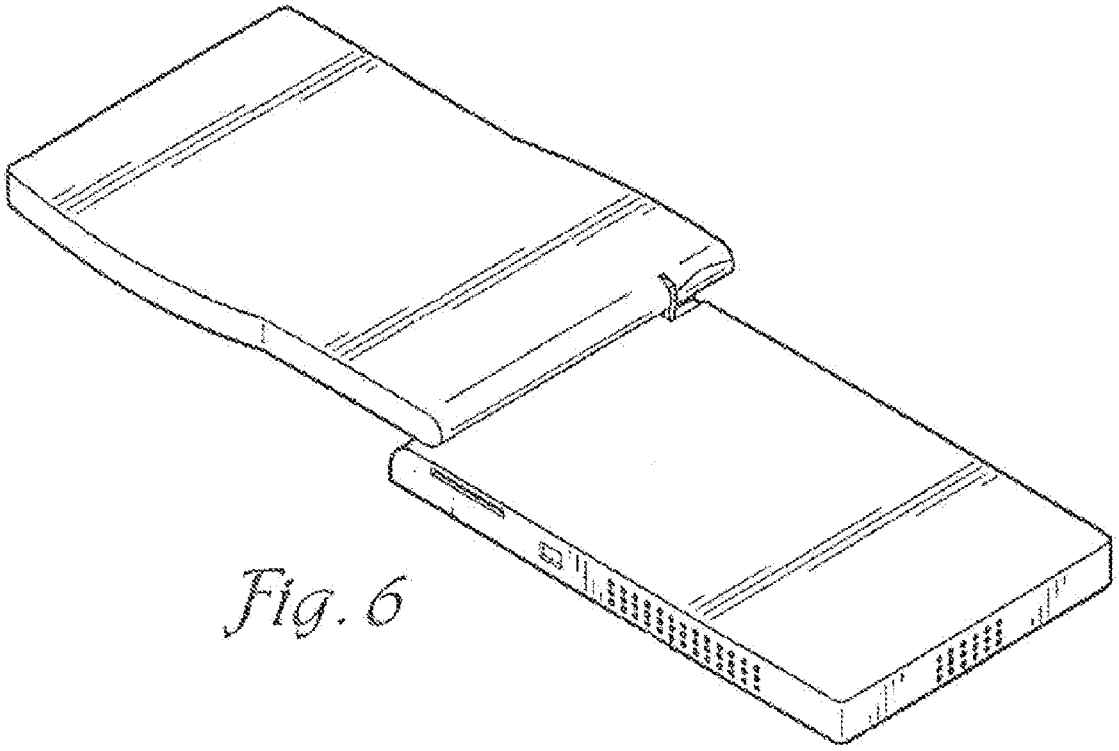
FIG. 6 is a view of the access point housing with the second enclosure at a 180-degree angle from the first enclosure.
Figure 7:
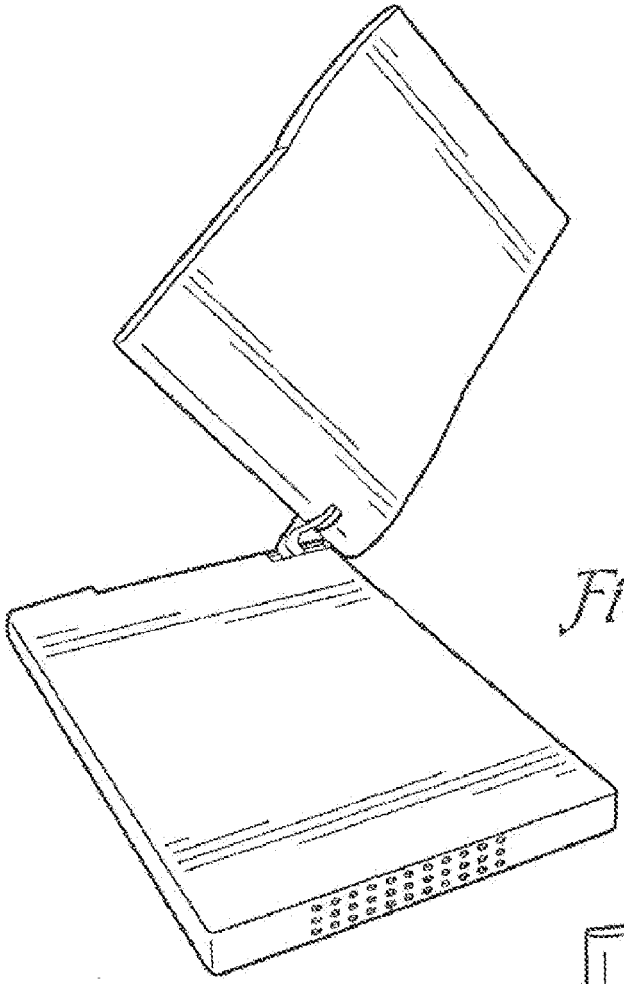
FIG. 7 is a view of the access point housing with the second enclosure rotated about one or more orthogonal axes from the first enclosure.
Figure 8:
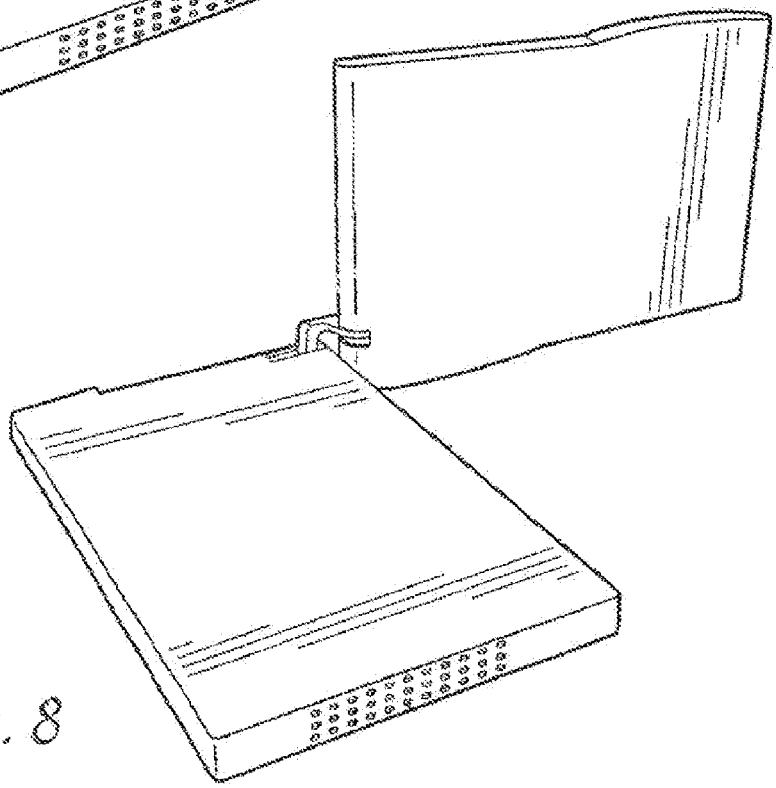
FIG. 8 is a view of the access point housing with the second enclosure rotated about one or more orthogonal axes from the first enclosure.
Figure 9:
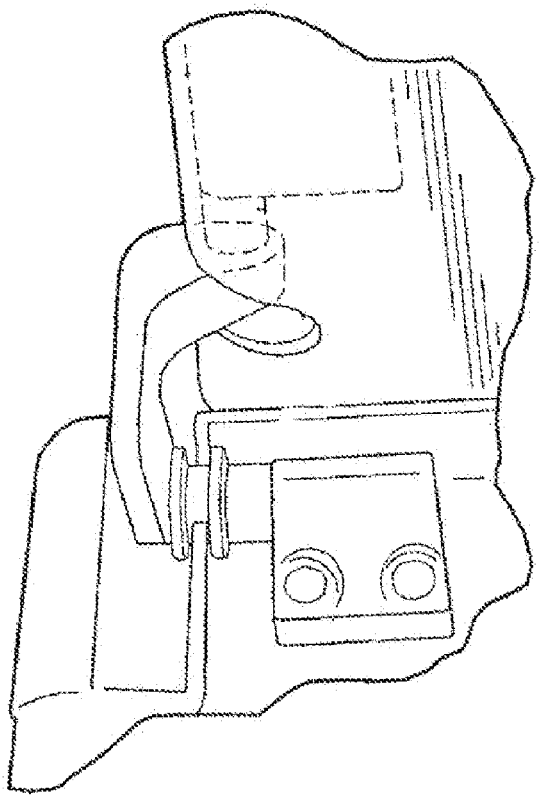
FIG. 9 is a view of an omni-directional hinge component.

The drawing figures do not limit the present invention to the specific embodiments disclosed and described herein. The drawings are not necessarily to scale, emphasis instead being placed upon clearly illustrating the principles of the invention.

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

An environment to host a wireless communication network is shown in FIG. 1. The network typically includes a plurality of wireless devices communicating with one or more access points. The network may utilize the IEEE standard protocol 802.11, including its variants, 802.11a, 802.11b, 802.11g, 802.11n, or any other similar protocol.

The environment may be any type of location where wireless device users may gather, such as a lecture hall, a library, an airport, a café, a house, or the like, as well as outdoor settings, e.g. a college campus. Accordingly, the environment and the number of users may vary from location to location. Each environment may have physical characteristics, such as signal reflecting surfaces, that vary and may affect signal coverage.

The wireless devices may include any type of electronic devices capable of sending and receiving radio frequency (RF) radiation. Typically, the wireless devices are mobile, such as laptop computers that include wireless network interface cards. However, other devices that are normally stationary, such as desktop computers with wireless network interface cards may also be considered wireless devices. Furthermore, hand-held devices, such as cell phones, personal digital assistants (PDAs), palmtop computers, and the like, that include RF transmitters and receivers may be considered wireless devices.

The access point may include a communication link that allows wireless device users to communicate using the wireless communication network. The access point can act as a connector between wireless device users and a wired network, wherein the wired network may assume a variety of protocols, topologies, and architectures, which may include the Internet. This has the effect that the access point may receive data wirelessly from users and transfer the data to the wired network. Additionally, the access point may transmit data wirelessly to users that is forwarded from the wired network.

The access point may be housed in a structure as constructed in accordance with various embodiments of the present invention and shown in FIGS. 2-8. The structure includes a first enclosure, a second enclosure, and an omni-directional hinge component.

The first enclosure may be of any size and shape, and in one embodiment is generally of a rectangular box shape and includes a top, a bottom, and four sides. The first enclosure may be manufactured from metal, plastic, or other suitable material, and may be used to house electronic circuitry mounted on one or more printed circuit boards (PCBs). The PCBs may be generally mounted to the bottom of the first enclosure. The electronic circuitry may include signal processing circuits, data processing circuits, network interface circuits, or combinations thereof that provide functionality for wireless communication networks in general and IEEE 802.11n networks in particular. Furthermore, input and output communication as well as power for the electronic circuits may be provided through ports on one or more sides of the first enclosure. In addition, the first enclosure may include a plurality of holes along one or more of the sides, as well as the top and bottom, to provide airflow to the electronic components mounted on the PCBs. Thus, radiated heat from the electronic circuits may escape the enclosure through the holes and cooler air may enter. The holes may be of varying shape and size depending on the dimensions of the first enclosure and the specifications for air flow.

The first enclosure may also function as a base. In some embodiments, the first enclosure may be mounted to a stationary object such as a wall, a ceiling, or a tabletop. Various methods for mounting are possible, but typically screws placed through the bottom of the first enclosure are used to fasten the housing to a stationary object surface. In other embodiments, the first enclosure may be placed on the surface of a stationary object, such as a table, a ledge, a counter, or a floor, without secure fastening. The choice of the location of the housing may be influenced by considerations such as ambient airflow that can provide ventilation and cooling for the electronic circuits.

The first enclosure may include a first coupling mechanism that is attached to the bottom of the first enclosure near one of the corners. A first end of the omni-directional hinge component is connected to the first coupling mechanism. The first coupling mechanism is spaced away from the corner to allow the connection to the omni-directional hinge component to occur within the first enclosure. The connection allows the omni-directional hinge component, and by extension the second enclosure, to rotate approximately 180° about a first axis along the edge of the first enclosure. Generally, the nature of the connection between the omni-directional hinge component and the first coupling mechanism is such that the omni-directional hinge component maintains its position once it is rotated about the first axis.

The second enclosure may also be of any size and shape, and in one embodiment is generally of a rectangular box shape and includes a top, a bottom, and four sides. The second enclosure may be manufactured from plastic, or other lightweight material, and may be used to house an array of antenna patches. The antenna patches may be used to transmit and receive data streams wirelessly to and from a plurality of wireless devices. Communication using the antenna patches may follow any wireless networking protocol in general and IEEE 802.11n in particular. An example of the antenna patch array is that which is disclosed in U.S. patent application Ser. No. 11/294,673, filed Dec. 5, 2005 in the name of inventors Rajendran Venugopalachary, Senthil Palanisamy, Srinath Sarang, and Vaduvur Bharghavan, titled "Omni-Directional Antenna Supporting Simultaneous Transmission and Reception of Multiple Radios with Narrow Frequency Separation", hereby incorporated by reference as if fully set forth herein. In various embodiments, the antenna patches are arranged in a 3×3 array. The antenna patches are mounted on one or more PCBs, which in turn may be mounted to the bottom of the second enclosure. The antenna patches may communicate with the electronic circuitry housed in the first enclosure through a plurality of wires or cables.

The second enclosure may include a second coupling mechanism that is attached to the bottom of the second enclosure near a corner corresponding to the location of the first coupling mechanism. A second end of the omni-directional hinge component is connected to the second coupling mechanism. The second coupling mechanism is spaced away from the corner to allow the connection to the omni-directional hinge component to occur within the second enclosure. The connection allows the second enclosure to rotate approximately 360° about a second axis along the edge of the second enclosure. Generally, the nature of the connection between the omni-directional hinge component and the second coupling mechanism is such that the second enclosure maintains its position once it is rotated about the second axis.

The second enclosure also may include an opening along one of the sides in proximity of the second coupling mechanism that creates a space for the omni-directional hinge component. The space allows the second enclosure to freely rotate about the second axis without being inhibited by the presence of the omni-directional hinge component.

The omni-directional hinge component may couple the first enclosure to the second enclosure. The first end includes a first pin that lies along the first axis and is insertably coupled with the first coupling mechanism. The second end includes a second pin that lies along the second axis is insertably coupled with the second coupling mechanism. Thus, the omni-directional hinge component rotates about both the first pin and the second pin.

Between the first end and the second end of the omni-directional hinge component may be a bend, such that the first end is oriented at an orthogonal angle with respect to the second end. This orthogonal orientation allows the second enclosure to be positioned at a wide range of angles with respect to the first enclosure. The access point housing may assume a closed position, wherein the first enclosure is roughly parallel to the second enclosure, with the bottom of the second enclosure resting against the top of the first enclosure. From the closed position, the second enclosure may be rotated in one direction approximately 180° about the first axis, or may be rotated in an orthogonal direction approximately 180° about the second axis. Additionally, the second enclosure may be rotated about both the first axis and the second axis at the same time. However, the second enclosure may not achieve its full range of rotation about the second axis, which is approximately 360°, until the second enclosure is rotated approximately 90° about the first axis.

During normal operation, the access point housing is mounted to a stationary object within an environment, with the bottom of the first enclosure being attached to a surface of the object. The second enclosure may be rotated about either the first axis, the second axis, or both in order to position the antenna patches such that signal coverage and data throughput are optimized.

Figure 10:
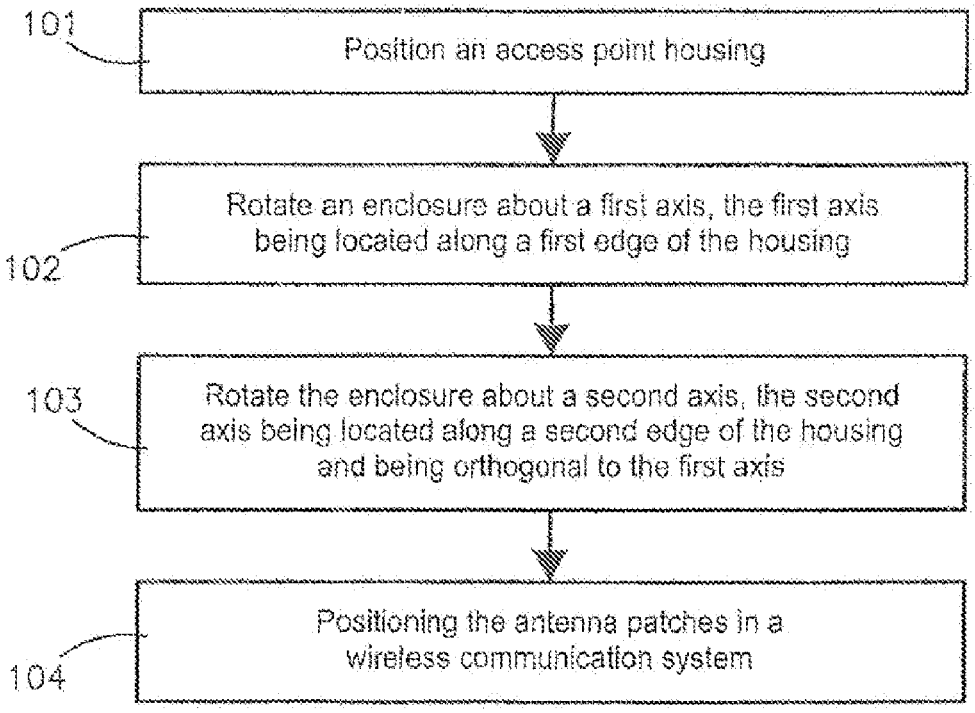
FIG. 10 is a flow diagram showing some of the steps that may be performed to maximize signal coverage in a wireless communication network.

FIG. 10 generally illustrates some of the steps that may be performed with various embodiments of the present invention to optimize placement in a wireless communication network. The steps as shown in FIG. 10 do not imply an order of execution. Some steps may be performed concurrently with or before other steps as shown in the flow diagram. In step 101, an access point housing is positioned in an environment as part of a wireless communication network that includes a plurality of wireless devices. The housing may be attached to a stationary object. In step 102, an enclosure that is part of the housing is rotated about a first axis, the first axis being located along a first edge of the housing. In step 103, the enclosure is rotated about a second axis, the second axis being located along a second edge of the housing and being orthogonal to the first axis. The enclosure may also be rotated about the first axis at the same time. In step 104, the antenna patches are positioned in a wireless communication system to optimize communication within the wireless communication system.

ALTERNATIVE EMBODIMENTS

After reading this application, those skilled in the art would recognize that the scope and spirit of the invention includes other and further embodiments beyond the specifics of those disclosed herein, and that such other and further embodiments would not require new invention or undue experimentation.

What is claimed is:

1. An access point structure for use with a wireless communication network, the structure comprising:

a first enclosure including a first coupling mechanism located near a corner of the first enclosure;

an omni-directional hinge component having orthogonally oriented first and second ends, the first end connected to the first coupling mechanism; and a second enclosure including a second coupling mechanism that is connected to the second end of the omni-directional hinge component and located near a corner of the second enclosure corresponding to the location of the first coupling mechanism, the second enclosure housing an array of antenna patches;

wherein said hinge component is disposed for routing one or more antenna cables from said first enclosure to said second enclosure.

2. The structure of claim 1, wherein the first enclosure houses access point electronic circuitry.

3. The structure of claim 1, wherein the second enclosure is rotatable approximately 180° about a first axis along an edge of the first enclosure adjacent to the first coupling mechanism.

4. The structure of claim 1, wherein the second enclosure is rotatable approximately 360° about a second axis along an edge of the second enclosure adjacent to the second coupling mechanism.

5. The structure of claim 4, wherein the second enclosure further includes an opening along the edge in proximity of the second coupling mechanism that allows the second enclosure to rotate freely about the second axis.

6. The structure of claim 1, wherein the connection between the omni-directional hinge component and the first coupling mechanism occurs within the first enclosure.

7. The structure of claim 1, wherein the connection between the omni-directional hinge component and the second coupling mechanism occurs within the second enclosure.

8. The structure of claim 1, wherein the first enclosure is mounted to a stationary object.

9. The structure of claim 1, wherein the array of antenna patches is positioned such that wireless communication network signal coverage is a maximum.

10. A structure as in claim 1, wherein said first enclosure includes a $1^{st}$ substantially planar element having one or more signal processing circuits disposed thereon, said signal processing circuits including access point circuitry disposed for operation in a wireless communication system;

said second enclosure includes a $2^{nd}$ substantially planar element defining a substantially planar region, wherein said antenna patches are disposed in an array in said substantially planar region, said antenna patches having an orientation allowing transmission or reception in a direction substantially orthogonal to said substantially planar region;

an orientation of said second enclosure defines a region in which said antenna patches have a maximum measure of signal coverage;

said hinge component electronically couples said antenna patches to said signal processing circuits.

11. A structure as in claim 1, wherein said first enclosure includes a $1^{st}$ substantially planar element;

said second enclosure includes a $2^{nd}$ substantially planar element having a closed position disposed substantially parallel to said $1^{st}$ substantially planar element;

said first coupling mechanism is disposed to orient said 1st substantially planar element at a $1^{st}$ angle with respect to said $2^{nd}$ substantially planar element, said $1^{st}$ angle being with respect to a 1st axis lying within said closed position;

said second coupling mechanism is disposed to orient said 1st substantially planar element at a $2^{nd}$ angle with respect to said $2^{nd}$ substantially planar element, said $2^{nd}$ angle being with respect to a $2^{nd}$ axis lying within said closed position and orthogonal to said $1^{st}$ axis, an intersection of said $1^{st}$ axis and said $2^{nd}$ axis being substantially at a corner of said $1^{st}$ substantially planar element and said $2^{nd}$ substantially planar element.

12. An access point structure for use with a wireless communication network, the structure comprising:

a first enclosure, of a generally rectangular box shape, including a first coupling mechanism located near a corner of the first enclosure;

an omni-directional hinge component having orthogonally oriented first and second ends, the first end connected to the first coupling mechanism within the first enclosure; and a second enclosure, of a generally rectangular box shape, including a second coupling mechanism that is connected to the second end of the omnidirectional hinge component within the second enclosure and located near a corner of the second enclosure corresponding to the location of the first coupling mechanism such that the second enclosure is rotatable approximately 180° about a first axis along an edge of the first enclosure adjacent to the first coupling mechanism, and such that the second enclosure is rotatable approximately 360° about a second axis along an edge of the second enclosure adjacent to the second coupling mechanism, the second enclosure having an opening along the edge in proximity of the second coupling mechanism that allows the second enclosure to freely rotate about the second axis, the second enclosure housing an array of antenna patches.

13. The structure of claim 1, wherein the array of antenna patches is positioned such that wireless communication network signal coverage is a maximum.

14. The structure of claim 1, wherein the first enclosure houses access point electronic circuitry.

* * * * *